US007152508B2

(12) United States Patent
McCalley, Jr. et al.

(10) Patent No.: US 7,152,508 B2
(45) Date of Patent: Dec. 26, 2006

(54) RATCHET EXTRACTION WRENCH

(75) Inventors: Richard Michael McCalley, Jr., Huntersville, NC (US); Robin E. Smith, Stanley, NC (US); Mark T. Vogeler, New Gloucester, ME (US)

(73) Assignee: Irwin Industrial Tool Company, Huntersville, NC (US)

( * ) Notice: Subject to any disclaimer, the term of this patent is extended or adjusted under 35 U.S.C. 154(b) by 0 days.

(21) Appl. No.: 10/906,635

(22) Filed: Feb. 28, 2005

(65) Prior Publication Data

US 2006/0117912 A1 Jun. 8, 2006

Related U.S. Application Data

(60) Provisional application No. 60/634,312, filed on Dec. 8, 2004.

(51) Int. Cl.
*B25B 13/50* (2006.01)

(52) U.S. Cl. ..... 81/53.2; 81/60; 81/63.2

(58) Field of Classification Search ..... 81/53.2, 81/60, 63.2, 186, 121.2
See application file for complete search history.

(56) References Cited

U.S. PATENT DOCUMENTS

| | | | | |
|---|---|---|---|---|
| 1,590,200 | A | 6/1926 | McGluckin | |
| 3,161,090 | A | 12/1964 | McLellan | |
| 3,996,819 | A | 12/1976 | King | |
| 4,440,047 | A * | 4/1984 | Robbins | 81/179 |
| 4,607,547 | A | 8/1986 | Martus | |
| 4,671,141 | A | 6/1987 | Hanson | |
| 4,781,082 | A | 11/1988 | Swertz | |
| 4,947,712 | A | 8/1990 | Brosnan | |
| 4,991,468 | A * | 2/1991 | Lee | 81/60 |
| 5,499,560 | A * | 3/1996 | Aeschliman | 81/63.2 |
| 5,551,320 | A * | 9/1996 | Horobec et al. | 81/53.2 |
| 5,737,981 | A | 4/1998 | Hildebrand | |
| 5,857,390 | A * | 1/1999 | Whiteford | 81/62 |
| 5,931,064 | A | 8/1999 | Gillespie | |
| 5,979,274 | A * | 11/1999 | Hsieh | 81/60 |
| 6,003,411 | A | 12/1999 | Knox et al. | |

(Continued)

OTHER PUBLICATIONS

J.H. Williams Advertisement, page No. 3, TURBOSOCKET Salvage Sockets.

*Primary Examiner*—David B. Thomas
*Assistant Examiner*—Robert Scruggs
(74) *Attorney, Agent, or Firm*—Dennis J. Williamson; Moore & Van Allen PLLC

(57) ABSTRACT

A combination ratchet wrench having a standard open-type or box-type wrench at one end thereof and a ratcheting extraction box at the other end thereof. The ratchet extraction wrench box is connected by a ratcheting mechanism to the wrench that allows rotation of the ratchet extraction wrench box relative to the wrench only in one direction. The ratchet extraction wrench box is provided with a fastener extraction head that has an interior bore extending inwardly from a receiving end. The bore has a plurality of helically-shaped grooves, each extending from the receiving end and curve radially and inwardly towards the central axis of the bore to form sharp ridges that extend in a helical fashion inside the bore. When the fastener extraction is placed over a fastener head, the ridges "bite" into the material of the fastener. Because the extraction head is formed as an integral part of the wrench there is no need to have a separate turning tool. Because a separate torque producing tool is not required and the wrench has a narrow profile, the extraction wrench can be used in tight spaces.

16 Claims, 4 Drawing Sheets

U.S. PATENT DOCUMENTS 6,044,944 A * 4/2000 Adams et al. ..... 192/44
6,047,620 A 4/2000 Kozak et al.
6,134,990 A * 10/2000 Ling et al. ..... 81/60
6,230,591 B1 * 5/2001 Ling et al. ..... 81/63
6,339,976 B1 1/2002 Jordan
6,389,931 B1 * 5/2002 Delaney et al. ..... 81/60
6,598,498 B1 * 7/2003 Pigford et al. ..... 81/53.2
6,644,148 B1 * 11/2003 Hu ..... 81/63.2
6,666,112 B1 * 12/2003 Hu ..... 81/63.1
6,732,614 B1 * 5/2004 Hu ..... 81/63.2
6,745,647 B1 * 6/2004 Wang ..... 81/60
6,807,882 B1 * 10/2004 Hu ..... 81/60
6,877,402 B1 4/2005 Pigford et al.
2005/0150331 A1 * 7/2005 Horobec ..... 81/53.2

* cited by examiner

RATCHET EXTRACTION WRENCH

CROSS-REFERENCE TO RELATED APPLICATIONS

This application claims priority under 35 U.S.C. 119(e) from co-pending provisional patent application Ser. No. 60/634,312, filed Dec. 8, 2004, by the inventors hereof, the entire disclosure of which is incorporated herein by reference.

BACKGROUND

The present invention relates to tools for turning threaded fasteners such as bolts, nuts, studs, and the like, and more particularly relates to a combination wrench having a ratchet extraction wrench box for removing threaded fasteners that have heads that have been rounded off or otherwise damaged.

It is well known to use extraction tools to remove threaded fasteners, such as a screw or bolt, that have been damaged to an extent that a standard wrench, screwdriver, alien wrench or other torque producing tool can no longer securely grip the fastener. These extraction tools often accomplish the extraction of the fastener through the use of "teeth" made up of angled faces located within an opening in the tool. To remove a fastener, the teeth partially cut into and grasp the fastener such that the damaged fastener is rotated with the extraction tool.

Typically, the extraction tools are rotated by a by a separate socket wrench that releasably engages an aperture in the extraction tool to apply torque thereto. A separate standard open or box wrench or adjustable wrench that engages the periphery of the extraction tool can also be used to apply torque to the extraction tool. Extraction tools typically are designed to be attached to a socket wrench on one end, and to be placed over a fastener at the other end. Thus, one end of the extraction tool typically will have an opening that is sized to be releasably engaged by the socket wrench, while the other end will have an opening that is sized to engage a fastener to be removed. For very large fasteners, the extraction tool may be more difficult to fabricate, since it requires a pair of openings machined into the tool whose sizes vary greatly from each other. Alternatively, the extraction tools may be designed having a male post that is releasably engaged by the chuck of a torque producing tool such as a power drill. With either design, a separate torque producing tool is required to turn the extraction tool. Moreover, a significant amount of space surrounding the fastener being removed is required in order to accommodate the extraction tool and separate torque producing tool. Finally, the need for a separate torque producing tool increases the complexity of the fastener extraction process and requires the user to have available a variety of different sized extraction heads and torque producing tools.

Accordingly, it would be desirable to have an extraction tool that overcomes one or more of the disadvantages and limitations described above.

SUMMARY OF THE INVENTION

The invention consists of a combination wrench having a standard open-type or box-type wrench at one end thereof and a ratcheting extraction box at the other end thereof. The ratcheting extraction box is provided with a fastener extraction head that has an interior bore extending inwardly from a receiving opening. The bore has a plurality of helically-shaped grooves extending from the receiving end and curved radially and inwardly towards the central axis of the bore. Adjacent grooves form sharp ridges that extend in a helical fashion inside the bore. When the fastener extraction is placed over a fastener head, the ridges "bite" into the material of the fastener. Because the extraction head is formed as an integral part of the wrench there is no need to have a separate torque producing tool. Moreover, because a separate torque producing tool is not required and the wrench of the invention has a narrow profile when compared to existing extraction devices, the ratchet extraction wrench of the invention can be used in much tighter spaces.

DETAILED DESCRIPTION OF AN EMBODIMENT OF THE INVENTION

Figure 1:
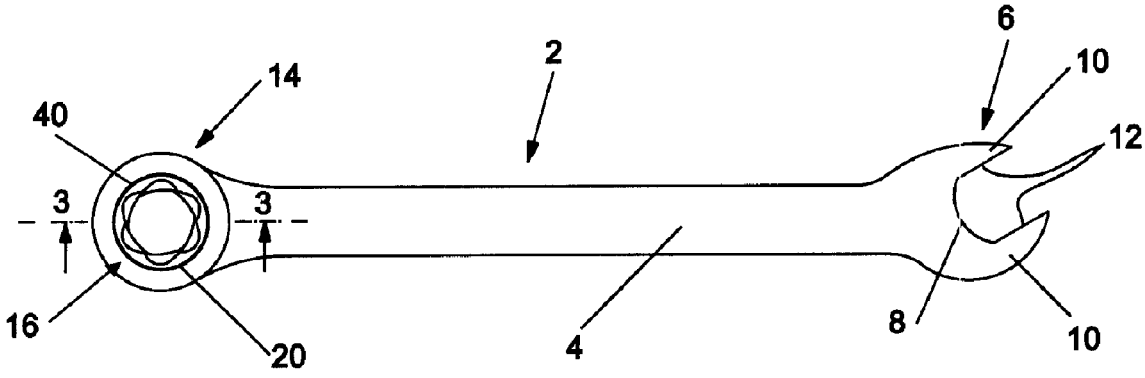
FIG. 1 is a plan view of an embodiment of the extraction wrench of the invention.

An embodiment of a ratchet extraction wrench 2 for removing threaded fasteners that have been damaged is shown in FIG. 1. The ratchet extraction wrench 2 consists of a body portion 4 having a first end 6 defining a standard open-type wrench 8 for tightening or loosening threaded fasteners. Open wrench 8 consists of a pair of arms 10 having flat surfaces 12 formed thereon for engaging a fastener. Flat surfaces 12 are spaced from one another a distance to receive and grip a fastener of a predetermined dimension as is known in the art. The wrenches are typically used in sets with each wrench of the set corresponding to a particular standard fastener size. The open-type wrench shown in FIG. 1 may be replaced by a standard box-type wrench where the opening for receiving the fastener is completely enclosed as is known in the art.

Body portion 4 has a second end 14 defining a ratchet extraction wrench box 16. As shown in greater detail in FIG. 2, second end 14 defines an aperture 20 that extends completely through the body portion 4. Aperture 20 has an annular groove 22 formed therein that extends around the interior of interior face 24 of opening 20. A recess 26 is provided in interior face 24 for receiving a pawl 28 that is biased by spring 30 out of recess 26 so as to extend into opening 20. Pawl 28 is formed with a plurality of teeth 32 for engaging mating teeth on extraction head 40 as will hereinafter be described.

Extraction head 40 consists of an annular shaped body 42 dimensioned to be closely but freely received in opening 20. Extraction head 40 is dimensioned such that the top and bottom surfaces of extraction head 40 are substantially flush with the top and bottom surfaces of second end 14 such that the extraction head does not extend outside of the profile of the wrench.

The outer surface 44 of body 42 is formed with an annular groove 46 that faces with groove 22 in opening 20 when the extraction head 40 is located in opening 22. The outer surface 44 also has teeth 48 formed thereon that extend about the outer periphery of head 40 and mate with teeth 32 on pawl 28. The teeth 48 and teeth 32 are formed such that when the extraction head is rotated in a first direction the teeth act as camming surfaces moving the pawl 28 against spring 30 and out of engagement with the extraction head 40 thereby allowing the extraction head to turn relative to body portion 14. When the extraction head 40 is rotated in the opposite direction teeth 48 and teeth 32 are configured to lock into engagement with one another thereby preventing the relative rotation between head 40 and body portion 14. Because head 40 is designed to extract fasteners, the teeth 32 and teeth 48 are arranged such that the head is locked relative to the wrench portion when the handle is turned in a direction to loosen the fastener being engaged. For most fasteners the head is locked when the wrench is rotated in a counter-clockwise direction. If the fastener is to be employed with a fastener having reverse threads the teeth would be configured to prevent rotation of the extraction head 40 in the clockwise direction.

To secure the extraction head 40 in opening 22 a deformable, resilient locking ring 38 is provided that is dimensioned to be received in the groove 46 formed in head 40. When the head is inserted into opening 20, the locking ring is compressed so as to be able to fit within opening 20. When groove 22 is aligned with groove 46, the ring 38 expands to its original non-compressed size such that it extends into groove 46. Ring 38 is dimensioned such that it extends into both grooves 22 and 46 in its normal non-compressed state thereby permanently locking extraction head 40 into opening 22. Permanently as used herein means that in normal use extraction head 40 is not removed from the body 4 and head 40 cannot be removed without disassembling or destroying the extraction wrench.

The extraction head 40 preferably is made of 4150 hardened steel, although in alternate embodiments other hardened steels may be used that have a hardness in the range approximately 50 to 60 Rockwell C. In other embodiments powdered metals may also be used to make the fastener extraction.

Figure 4:
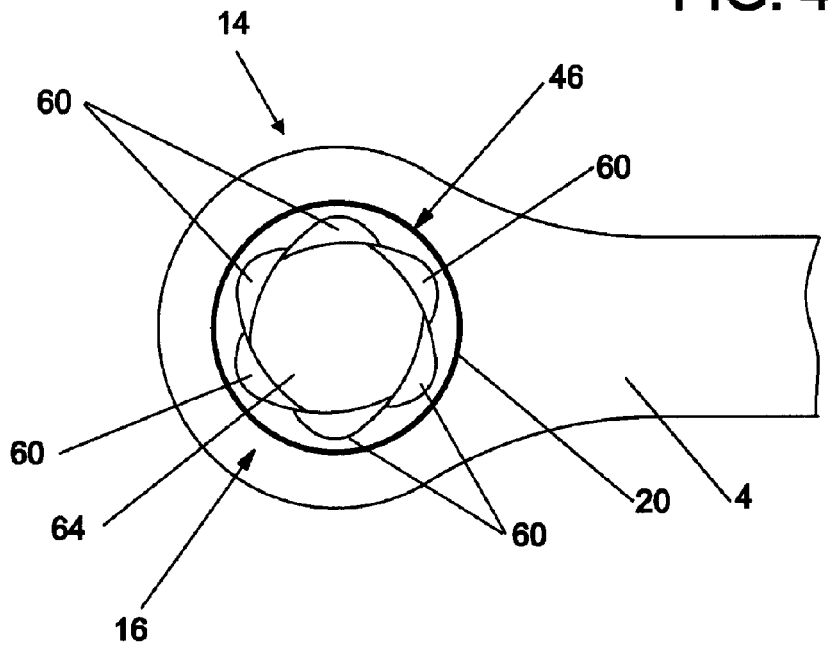
FIG. 4 is a detailed plan view of the extraction head of FIG. 1.
Figure 2:
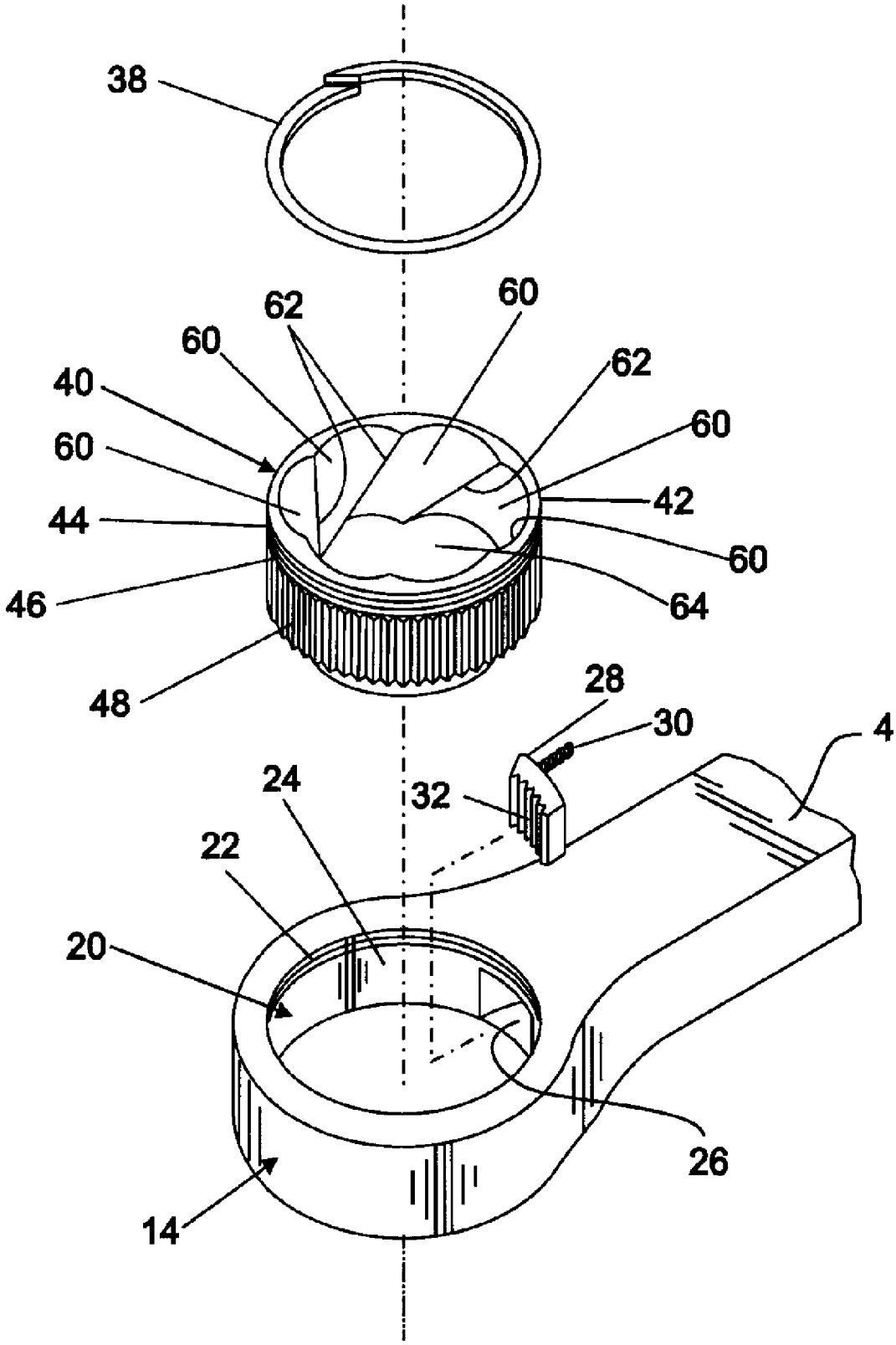
FIG. 2 is an exploded perspective view of the embodiment of the extraction wrench of the invention shown in FIG. 1.
Figure 3:
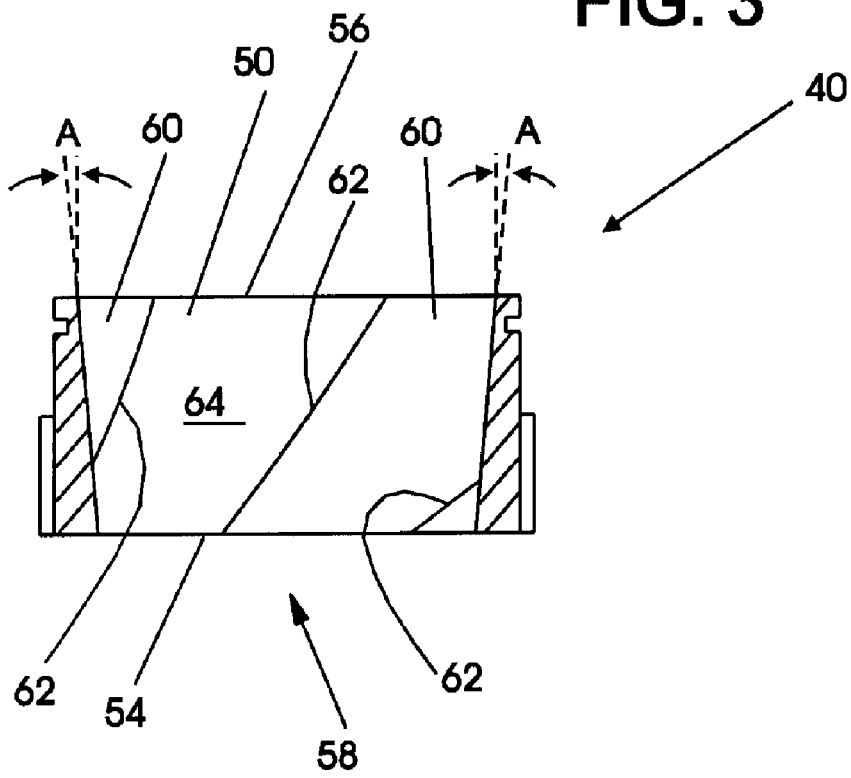
FIG. 3 is a section view of the extraction head taken along line 3—3 of FIG. 1.

Referring to FIGS. 2, 3 and 4, the extraction head 40 includes a first end 54 and a receiving end 56. An interior bore 58 extends inwardly from a receiving end 56. The bore 58 has a plurality of helically-shaped grooves 60, each having an arcuate cross-section. The grooves 60 extend from the receiving end 56 towards the first end 54 and curve radially and inwardly towards the central axis of the bore 58. In a preferred embodiment there are six grooves 50, so as to fit over a hexagonally shaped fastener head such as, by way of example, a nut. In additional embodiments, as those skilled in the art will recognize, there may be a different number of grooves, with additional embodiments having at least two grooves. Adjacent grooves 50 form sharp ridges 62 that extend in a helical fashion inside the bore 48. As will be discussed in more detail below, when the fastener extraction 2 is placed over a fastener head, the ridges "bite" into the material of the fastener.

The bore 58 and the grooves 60 define a generally frusto-conical receiving area 64. The receiving area 64 angles inwardly from the receiving end 56 towards the first end 54. This angle, known as a draft angle and depicted as A in FIG. 3, preferably is about 4 degrees, and thus causes the diameter of the receiving area 64 to decrease as it approaches the first end 54. In other embodiments, however, the draft angle A may be in the range of from about 1 to 8 degrees inclusive. The draft angle A allows the extraction head 40 to more efficiently "grip" a damaged fastener without slipping.

The wrench of the invention has been shown and described as having a standard open-type or box-type wrench at one end thereof and the ratchet extraction wrench box 16 at the other end thereof. The standard wrench could be replaced by a second ratchet extraction wrench box 16 such that the wrench would have the ratcheting feature at both ends thereof. In this embodiment one ratchet extraction wrench box 16 would preferably be dimensioned to receive fasteners of a first dimension range and the second ratchet extraction wrench box 16 would be dimensioned to receive fasteners of a second dimension range different than the first dimension range.

The fastener extraction wrench is shown with reference to a fastener having a right-hand thread. Those skilled in the art, however, will readily recognize the fastener extraction may be used to extract fasteners having left-hand threads by merely reversing the orientation of the grooves 60 and reversing the orientation of teeth 32 and teeth 48. Rotation of the fastener extraction relative to the fastener during loosening will cause the ridges to bite into the fastener. Because of the orientation of the ridges, further rotation will cause the fastener extraction to be seated more firmly upon the fastener due to the decreasing diameter of the receiving area. The ridges are designed to deform the material of the fastener as greater force is applied to the wrench such that the ridges bite or dig into the material of the fastener. The wrench of the invention operates in a ratcheting manner and greatly simplifies the extraction process because a single tool is used to provide both the extraction tool and the torque producing tool.

Once a fastener is extracted and is no longer in contact with the fastener extraction, the arcuate shape of the grooves and surfaces prevent large amounts of fastener material from remaining within the bore. There are no sharp crevices or creases for fastener material to get caught. Although a surface finish is not required, the surface finish of the bore preferably is made of an R16 surface finish in order to provide a smooth surface to further prevent material build up. In alternate embodiments, moreover, other suitable finishes that provide for smoothness of the bore may also be used.

Figure 5:
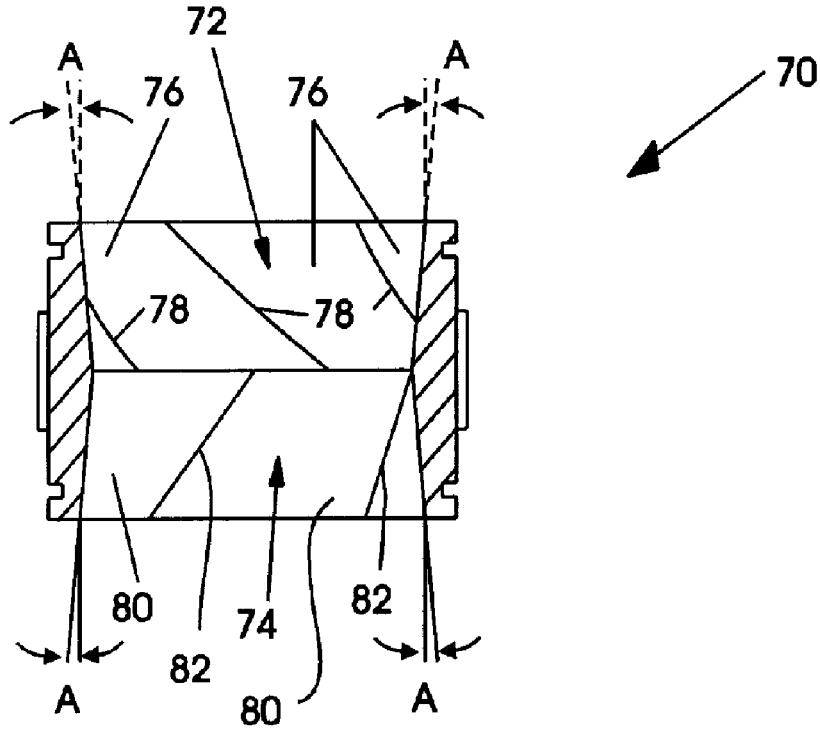
FIG. 5 is a section view of the extraction head similar to FIG. 3 of another embodiment of the extraction head.

An alternate embodiment of the extraction head is shown at 70 in FIG. 5 and includes a first receiving area 72 and a second receiving area 74 where receiving area 74 is used to extract right-hand threaded members and receiving area 72 is used to extract left-hand threaded members. Specifically, receiving area 72 has a set of grooves 76 that form ridges 78 as described with reference to FIGS. 1 through 4. Receiving area 74 also has a set of grooves 80 that form ridges 82 as described where the grooves in receiving area 74 are disposed in reverse orientation to the grooves in receiving area 72. The device operates on both right and left hand members by simply turning the wrench over, it being appreciated that when the wrench is turned over the head is locked relative to the wrench portion in the clockwise direction in one orientation and in the counter-clockwise direction in the opposite orientation.

Figure 6:
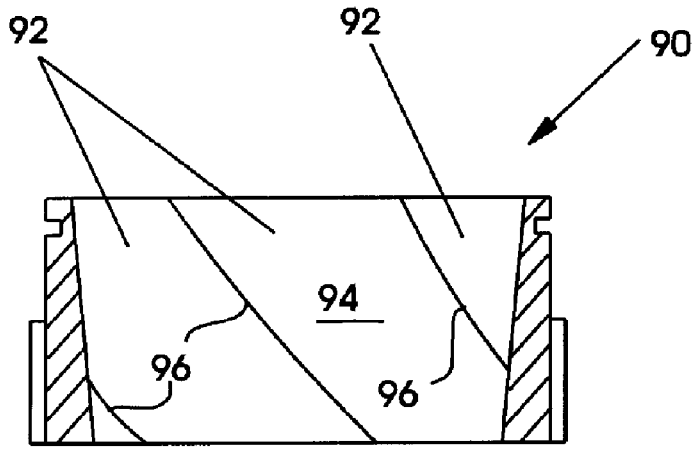
FIG. 6 is a section view of an insertion head similar to extraction head shown in FIG. 3.

The wrench of the invention could also be used to screw on a threaded fastener rather than unscrew the fastener as previously described. It is contemplated that in certain applications it may be desireable to reattach a fastener that has been removed even though the fastener is damaged to an extent that a standard torque producing tool can no longer securely grip the fastener. In order to tighten a damaged fastener the insertion head 90 shown in FIG. 6 is provided. Insertion head 90 is the same as extraction head 40 shown in FIG. 3 except that the helically-shaped grooves 92 curve radially and inwardly towards the central axis of the bore 94 in the opposite direction from grooves 60 shown in FIG. 3. Adjacent grooves 92 form sharp ridges 96 that extend in a helical fashion inside the bore 48 such that when the fastener extraction 2 is placed over a fastener head, the ridges "bite" into the material of a right-hand fastener when the head 90 is rotated clockwise. Thus, the wrench of the invention using insertion head 90 can be used to tighten right-hand fasteners that are otherwise too damaged to be gripped by standard wrenches.

Moreover, the head 70 of FIG. 5 could be used for both insertion and extraction. As previously described receiving area 72 of head 70 is used to extract left-hand threaded fasteners. If receiving area 72 is used on a right-hand threaded fastener it will tighten the fastener when the wrench is turned clockwise. Thus, when used on right-hand fasteners, head 70 will act as a combination extraction/insertion head that can be used to tighten right-hand fasteners that are otherwise too damaged to be gripped by standard torque producing tools by using bore 72 or loosen right-hand fasteners by turning over the wrench and using bore 80.

Figure 7:
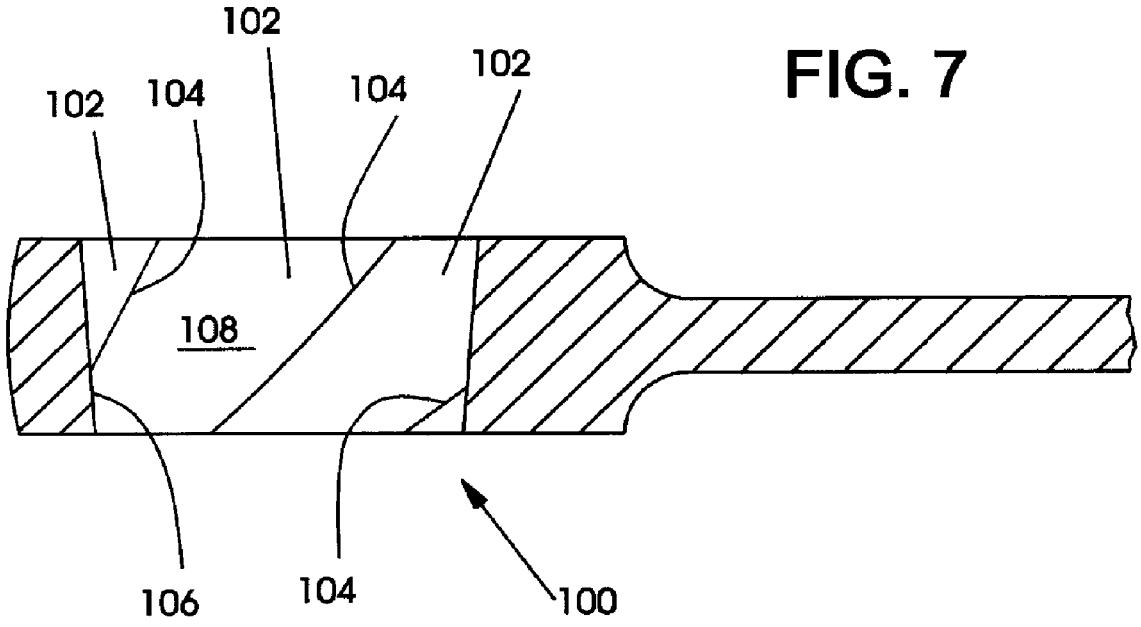
FIG. 7 is a section view of another embodiment of the extaction head of the invention.

Another embodiment of the wrench of the invention is shown in FIG. 7 and consists of a box-type wrench 100 where the hex shape of the standard box-type wrench is replaced by the fastener extractor grooves that are cut directly into the wrench. In this embodiment the grooves 102 and ridges 104 are configured as previously described with reference to FIGS. 3 and 4. Because the grooves are formed directly in the interior surface of aperture 106 to create fastener receiving area 108, this arrangement does not provide the ratcheting effect of the previously described embodiments. This embodiment does present an extraction/insertion wrench that does not require a separate torque producing tool and has a thin profile that can fit into tight spaces. Moreover, this arrangement can be used on a wrench that has the ratchet extraction box wrench, or a standard wrench at the other end thereof.

Thus it can be seen that the present ratcheting extraction wrench provides a simple and highly effective device for applying torque to extract a fastener that has a head that has been rounded off or otherwise damaged. The extraction wrench of the invention may be utilized alone without the need for any other torque producing tools. As will be readily appreciated, the extraction wrench may be built to various sizes in order to be used with a wide range of fasteners. While embodiments of the invention are disclosed herein, various changes and modifications can be made without departing from the spirit and scope of the invention. The scope of the invention is indicated in the appended claims, and all changes that come within the meaning and range of equivalents are intended to be embraced therein.

What is claimed is:

1. A fastener extraction apparatus comprising a body; and an extraction head in permanent ratcheting engagement with said body wherein the extraction head has a receiving end having an interior bore that angles inwardly, said interior bore including at least two grooves that extend along said interior bore, adjacent ones of said grooves form sharp helically shaped ridges, said ridges being adapted to bite into a fastener for extraction.

2. The fastener extraction apparatus of claim 1 wherein said body is a wrench body having said extraction head in one end thereof and a standard wrench in an other end thereof.

3. The fastener extraction apparatus of claim 1 wherein the body defines an aperture said aperture receiving said extraction head.

4. The fastener extraction apparatus of claim 1 wherein the body defines an aperture said aperture receiving said extraction head, said extraction head including teeth for engaging a pawl carried by said body.

5. The fastener extraction apparatus of claim 1 wherein the body defines a first end portion, said first end portion having opposed outer surfaces and said extraction head being contained within said opposed outer surfaces.

6. The fastener extraction apparatus of claim 1 wherein said grooves curve radially and inwardly towards a central axis of said interior bore.

7. The fastener extraction apparatus of claim 6, wherein said arcuate grooves are smooth, radiused surfaces.

8. A wrench comprising a wrench body having a first end and a second end, said first end having a standard wrench and said second end having a fastener extraction head, said fastener extraction head being in permanent rotational engagement with the wrench body, wherein the extraction head has a receiving end having an interior bore, said interior bore including at least two grooves that extend along said interior bore, adjacent ones of said grooves form sharp ridges that angle inwardly, said ridges being adapted to bite into and deform a fastener for extraction said fastener extraction head being in ratcheting engagement with said second end such that the fastener extraction head can rotate relative to the wrench body only in a first direction.

9. A fastener extraction wrench comprising a wrench body having a first end and a second end, said first end having a standard wrench and said second end defining an aperture for permanently retaining an extraction head, wherein the extraction head has a receiving end having an interior bore that angles inwardly, said interior bore including at least two grooves that extend along said interior bore, adjacent ones of said grooves form sharp helically shaped ridges, said ridges being adapted to bite into a fastener for extraction said extraction head being fixed in said wrench body and said extraction head being engaged by a member carried by said second end such that the extraction head can rotate relative to the body only in a first direction.

10. A fastener extraction apparatus comprising a body;

a fastener extraction head permanently secured to said body, wherein the extraction head has a receiving end having an interior bore, said interior bore including at least two grooves and extend along said interior bore, adjacent ones of said grooves form sharp ridges that angle inwardly, said ridges being adapted to bite into a fastener for extraction; and means for allowing the bolt extraction head to rotate relative to the body in a first direction but preventing rotation of the bolt extraction head relative to said body in an opposite direction.

11. The fastener extraction apparatus of claim 10 wherein said fastener extraction head has first and second fastener receiving areas.

12. The fastener extraction apparatus of claim 11 wherein the first fastener receiving area is used to extract right-hand fasteners and said second fastener receiving area is used to extract left-hand fasteners.

13. The fastener extraction apparatus of claim 11 wherein the first fastener receiving area is used with the body in a first orientation and said second fastener receiving area is used with the body in a second orientation.

14. A wrench comprising;

a wrench body having a first end and a second end, said first end having a fastener insertion head, said fastener insertion head including ridges that bite into an deform said fastener when the wrench is turned in a first direction that will tighten the fastener, said fastener insertion head being in permanent ratcheting engagement with said second end such that the fastener insertion head can rotate relative to the wrench body only in a second direction opposite to said first direction.

15. A fastener insertion and extraction apparatus comprising a body;

a fastener insertion/extraction head permanently secured to said body; and means for allowing the insertion/extraction head to rotate relative to the body in a first direction but preventing rotation of the bolt extraction head relative to said body in an opposite direction, wherein said fastener extraction head has first and second fastener receiving areas, the first fastener receiving area is used to loosen right-hand fasteners and said second fastener receiving area is used to tighten right-hand fasteners.

16. The fastener insertion and extraction apparatus of claim 15 wherein the first fastener receiving area is used with the body in a first orientation and said second fastener receiving area is used with the body in a second orientation.

* * * * *